US011515081B2

(12) United States Patent
Takahashi et al.

(10) Patent No.: US 11,515,081 B2
(45) Date of Patent: Nov. 29, 2022

(54) COIL COMPONENT

(71) Applicant: TDK CORPORATION, Tokyo (JP)

(72) Inventors: Hideomi Takahashi, Tokyo (JP); Toshifumi Komachi, Tokyo (JP); Toshio Tomonari, Tokyo (JP)

(73) Assignee: TDK CORPORATION, Tokyo (JP)

( * ) Notice: Subject to any disclaimer, the term of this patent is extended or adjusted under 35 U.S.C. 154(b) by 607 days.

(21) Appl. No.: 16/483,376

(22) PCT Filed: Jan. 15, 2018

(86) PCT No.: PCT/JP2018/000783
§ 371 (c)(1),
(2) Date: Aug. 2, 2019

(87) PCT Pub. No.: WO2018/147000
PCT Pub. Date: Aug. 16, 2018

(65) Prior Publication Data

US 2020/0013545 A1 Jan. 9, 2020

(30) Foreign Application Priority Data

Feb. 13, 2017 (JP) ..... JP2017-023859

(51) Int. Cl.
*H01F 27/24* (2006.01)
*H01F 27/34* (2006.01)
(Continued)

(52) U.S. Cl.
CPC ..... *H01F 27/346* (2013.01); *H01F 27/245* (2013.01); *H01F 27/2823* (2013.01); *H01F 27/29* (2013.01)

(58) Field of Classification Search
CPC ..... H01F 27/2823
(Continued)

(56) References Cited

U.S. PATENT DOCUMENTS

2003/0071704 A1* 4/2003 Toi ..... H01F 27/36 336/83
2005/0052267 A1* 3/2005 Singu ..... H01F 27/292 336/83
(Continued)

FOREIGN PATENT DOCUMENTS

JP 06197479 H 7/1994
JP 06231975 H 8/1994
(Continued)

OTHER PUBLICATIONS

English translation of JP2008915359 (Year: 2008).*

*Primary Examiner* — Ronald Hinson
(74) *Attorney, Agent, or Firm* — Young Law Firm, P.C.

(57) ABSTRACT

An object of the present invention is to provide a coil component in which leakage of magnetic flux from a magnetic gap is reduced. A coil component includes: a drum-shaped core 20 having a winding core part 30 with a gap G formed therein and first and second flange parts 31 and 32; a plate-like core 40 fixed to the first and second flange parts 31 and 32; and wires W1 to W3 wound around the winding core part 30 and each having one end connected to a terminal electrode provided on the first flange part 31 and the other end connected to a terminal electrode provided on the second flange part 32. According to the present invention, the gap G formed in the winding core part 30 functions as a magnetic gap, and magnetic flux leaking from the magnetic gap is shielded by the plate-like core 40. Thus, even when the magnetic gap is provided to reduce a tolerance due to characteristic variation of a magnetic material, it is possible to solve the problem that other electronic components are affected by the leakage magnetic flux.

11 Claims, 7 Drawing Sheets

(51) Int. Cl.
*H01F 27/245* (2006.01)
*H01F 27/28* (2006.01)
*H01F 27/29* (2006.01)

(58) Field of Classification Search
USPC ..... 336/212
See application file for complete search history.

(56) References Cited

U.S. PATENT DOCUMENTS

2014/0203901 A1* 7/2014 Chamura ..... H01F 37/00
336/220
2014/0313002 A1* 10/2014 Kuo ..... H01F 27/385
336/178

FOREIGN PATENT DOCUMENTS

| | | | |
|---|---|---|---|
| JP | 2007165623 | A | 6/2007 |
| JP | 2009260014 | A | 11/2009 |
| JP | 2011077178 | A | 4/2011 |
| JP | 201196815 | A | 5/2011 |
| JP | 2013214628 | A | 10/2013 |
| JP | 2014033039 | A | 2/2014 |
| JP | 2016178174 | A | 10/2016 |

* cited by examiner

COIL COMPONENT

TECHNICAL FIELD

The present invention relates to a coil component and, more particularly, to a surface-mount type coil component using a drum-shaped core.

BACKGROUND ART

In recent years, electronic components used in information terminals such as smartphones and on-vehicle electric devices are strongly required to have small size and low height. Thus, also for a coil component such as a transformer, many surface-mount type coil components using not a toroidal-shaped core, but a drum-shaped core are used. For example, Patent Document 1 discloses a boosting transformer using a drum-shaped core.

The coil component described in Patent Document 1 has a structure in which a plate-like core is fixed to the drum-shaped core, thereby constituting a closed magnetic loop.

CITATION LIST

Patent Document

[Patent Document 1] JP 2013-214628A

SUMMARY OF INVENTION

Technical Problem to be Solved by Invention

In coil components using a drum-shaped core, a tolerance is specified for each product, and a variation in a parameter, such as an inductance value, are allowed within the range of the specified tolerance. Coil components used in on-vehicle electronic devices generally have a small tolerance and, thus, the parameter may often exceed the specified tolerance due to characteristic variation of a magnetic material used for a drum-shaped core or a plate-like core to be used.

To reduce a tolerance due to characteristic variation of a magnetic material, the following method is available. That is, a magnetic gap is formed between the drum-shaped core and the plate-like core to make a change in the inductance value by the magnetic gap dominant to thereby conceal the characteristic variation of the magnetic material.

However, in this method, it is necessary to significantly increase the magnetic gap between the drum-shaped core and the plate-like core depending on target characteristics and, in this case, the magnetic flux leaking from the magnetic gap may affect other electronic components.

It is therefore an object of the present invention to provide a coil component in which leakage of magnetic flux from the magnetic gap is reduced.

Means for Solving the Problem

A coil component according to the present invention includes: a drum-shaped core having a winding core part and first and second flange parts provided respectively at both ends of the winding core part in the axial direction of the winding core part; a plate-like core fixed to the first and second flange parts; a first terminal electrode provided on the first flange part; a second terminal electrode provided on the second flange part; and a wire wound around the winding core part and having one end connected to the first terminal electrode and the other end connected to the second terminal electrode, wherein a first magnetic gap is formed in a magnetic path passing between the first and second flange parts through the winding core part.

According to the present invention, the magnetic gap is formed in the drum-shaped core itself, so that magnetic flux leaking from the magnetic gap can be shielded by the plate-like core. Thus, even when the magnetic gap is provided to reduce a tolerance due to characteristic variation of a magnetic material, it is possible to solve the problem that other electronic components are affected by the leakage magnetic flux.

In the present invention, the first magnetic gap is preferably a gap that divides the winding core part in the axial direction. This allows the gap formed in the winding core part to function as a magnetic gap. In this case, the gap is preferably formed at the intermediate position of the winding core part in the axial direction. This prevents a change in the distribution of leakage magnetic flux that can be caused according to a mounting direction and, hence, facilitates handling.

The coil component according to the present invention preferably further includes a non-magnetic material used to fill the gap. This allows the two sections constituting the winding core part divided by the gap to be connected by the non-magnetic material, facilitating winding work of the wire. In this case, the non-magnetic material may further be formed on the surface of the winding core part. Such a structure is obtained by molding the winding core part having the gap formed therein.

In the present invention, the winding core part divided by the gap may have shapes fitted to each other. This facilitates connection work of the divided winding core part.

In the present invention, a second magnetic gap may be formed between the first and second flange parts and the plate-like core. This makes it possible to enhance the effect of the magnetic gap. In this case, the first magnetic gap is preferably made larger in size than the second magnetic gap. This makes it possible to minimize leakage magnetic flux from the second magnetic gap.

Advantageous Effects of the Invention

As described above, according to the present embodiment, there can be provided a coil component in which leakage of magnetic flux from the magnetic gap is reduced.

BRIEF DESCRIPTION OF DRAWINGS

FIGS. 5A and 5B are views illustrating the spread of magnetic flux in the xz and xy directions, respectively, in the coil component 10X according to the comparative example, and FIGS. 5C and 5D are views illustrating the spread of magnetic flux in the xz and xy directions, respectively, in the coil component 10 according to the present embodiment.

MODE FOR CARRYING OUT THE INVENTION

Preferred embodiments of the present invention will be explained below in detail with reference to the accompanying drawings.

Figure 1:
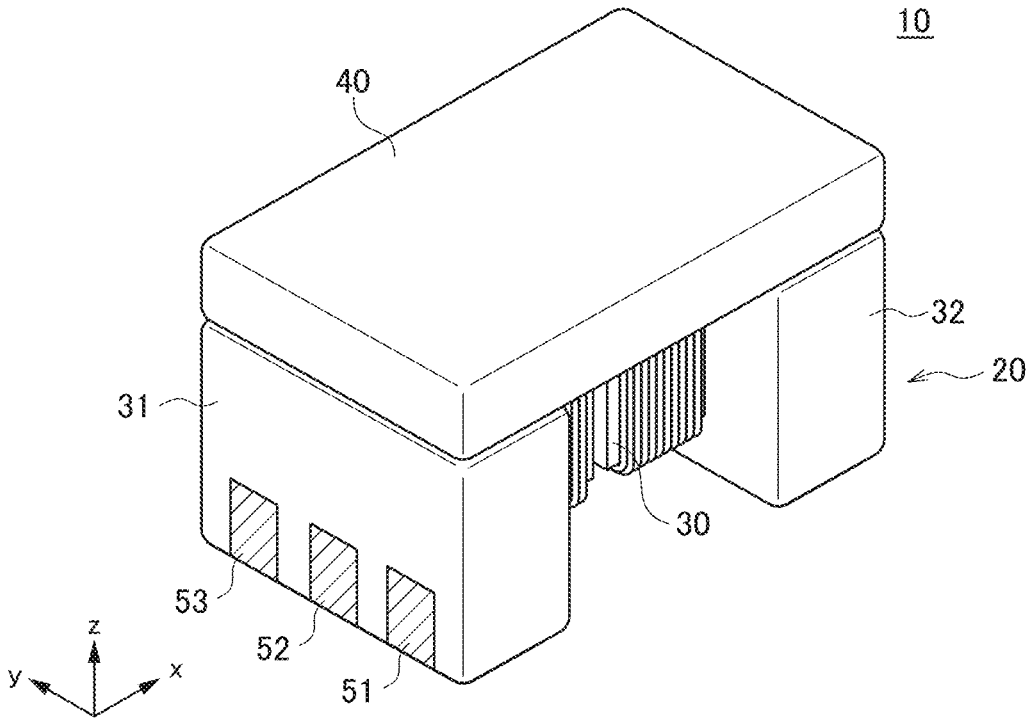
FIG. 1 is a schematic perspective view illustrating the outer appearance of a coil component 10 according to a preferred embodiment of the present invention.
Figure 2:
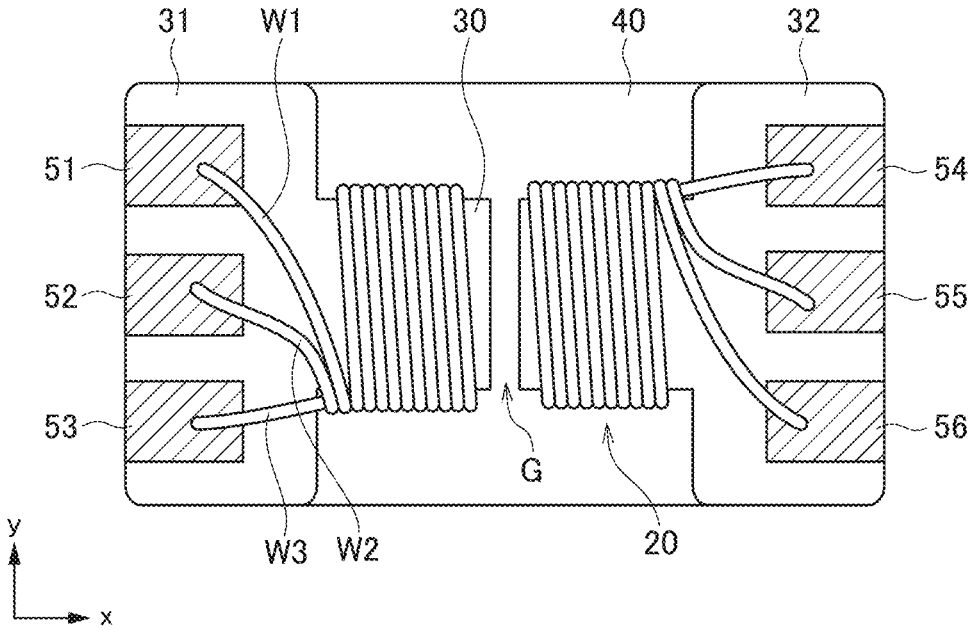
FIG. 2 is a schematic plan view of the coil component 10 as viewed from the mounting surface side thereof.

FIG. 1 is a schematic perspective view illustrating the outer appearance of a coil component 10 according to a preferred embodiment of the present invention. FIG. 2 is a schematic plan view of the coil component 10 as viewed from the mounting surface side thereof.

The coil component 10 according to the present invention is a transformer and has a drum-shaped core 20 and a plate-like core 40 as illustrated in FIGS. 1 and 2. The drum-shaped core 20 and plate-like core 40 are each made of a ceramic material having high permeability, such as ferrite, and are fixed to each other through an adhesive. The coil component according to the present invention is not limited to the transformer, and there is no restriction on the type thereof as long as it is a surface-mount type coil component using the drum-shaped core and plate-like core. Thus, the coil component according to the present invention may be a general-purpose coil component for inductance, or a coil component for a specific application, e.g., for a common-mode filter, for a pulse transformer, or for a balun transformer.

The drum-shaped core 20 has a winding core part 30 and first and second flange parts 31 and 32 provided at both ends of the winding core part 30 in the axial direction (x-direction) thereof, respectively. In the present embodiment, as one example, three wires W1 to W3 are wound around the winding core part 30. Further, three terminal electrodes 51 to 53 are provided on the first flange part 31, and three terminal electrodes 54 to 56 are provided on the second flange part 32. One ends of the wires W1 to W3 are connected to different terminal electrodes 51 to 53, respectively, and the other ends thereof are connected to different terminal electrodes 54 to 56, respectively.

The plate-like core 40 is fixed to the upper surfaces of the first and second flange parts 31 and 32. The upper surfaces of the first and second flange parts 31 and 32 refer to xy surfaces positioned on the opposite side of the mounting surface. The terminal electrodes 51 to 53 are provided over the mounting surface and the outer surface of the first flange part 31, and terminal electrodes 54 to 56 are provided over the mounting surface and the outer surface of the second flange part 32.

Figure 3:
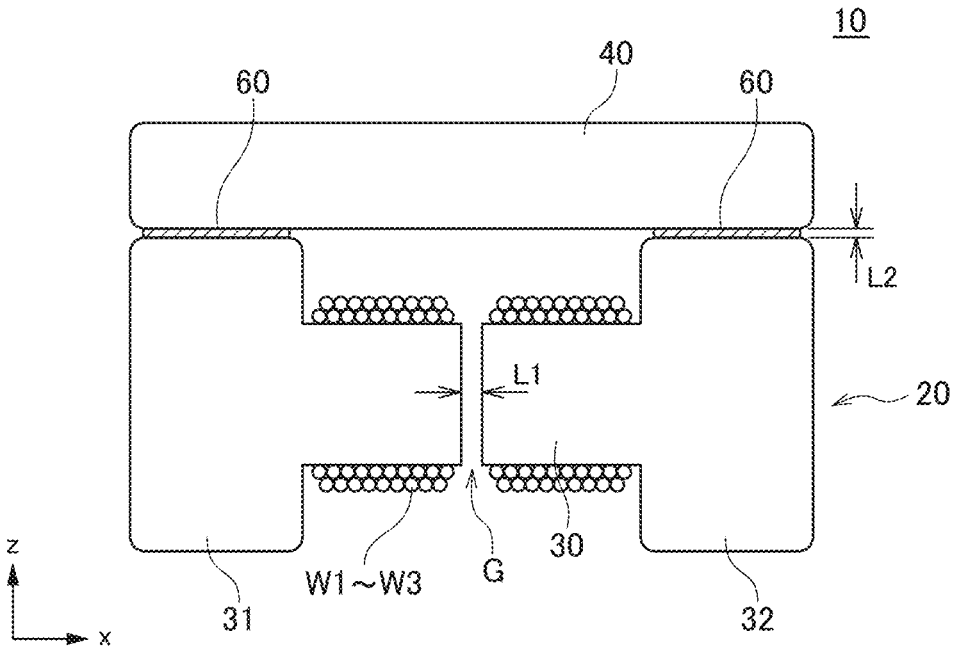
FIG. 3 is an xz cross-sectional view of the coil component 10.

FIG. 3 is an xz cross-sectional view of the coil component 10.

As illustrated in FIG. 3, the coil component 10 according to the present embodiment has a feature in that the winding core part 30 of the drum-shaped core 20 is divided in the x-direction by a gap G. The gap G divides a magnetic path constituted by the winding core part 30 at the intermediate position in the x-direction, whereby a first magnetic gap is formed. The first magnetic gap is formed to conceal the characteristic variation of a magnetic material by leaking magnetic flux. That is, when the magnetic gap is not provided, the characteristic variation of the magnetic material is dominant in the variation of parameters such as inductance value, while when the gap is not provided, it is possible to conceal the characteristic variation of the magnetic material since the parameter such as an inductance value significantly changes depending on the width of the gap G.

Actually, the plate-like core 40 is fixed to the drum-shaped core 20 through an adhesive 60, so that a second magnetic gap is formed between the drum-shaped core 20 and the plate-like core 40. In this case, a width L1 of the gap G is preferably made larger than a thickness L2 of the adhesive 60. For example, the width L1 of the gap G is set to 20 μm to 100 μm, and the thickness L2 of the adhesive 60 is set to 5 μm to 10 μm. This can suppress leakage magnetic flux from the second magnetic gap.

Figure 4:
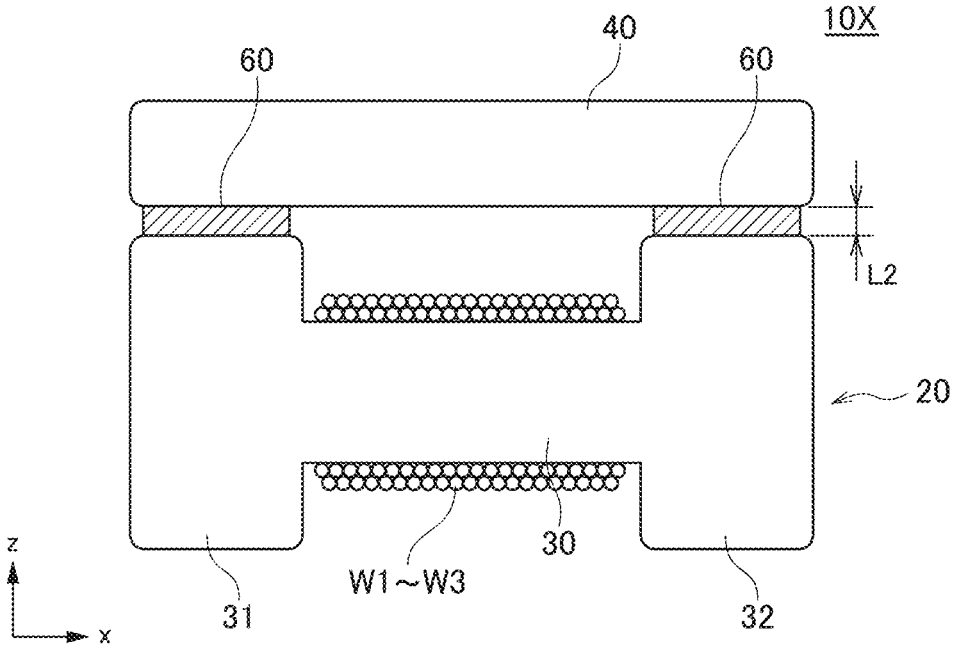
FIG. 4 is an xz cross-sectional view of a coil component 10X according to a comparative example.

FIG. 4 is an xz cross-sectional view of a coil component 10X according to a comparative example.

The coil component 10X illustrated in FIG. 4 differs from the coil component 10 according to the present embodiment in that the gap G is not formed in the winding core part 30. In order to sufficiently conceal the characteristic variation of the magnetic material in such a configuration, it is necessary to enlarge the second magnetic gap formed between the drum-shaped core 20 and the plate-like core 40. That is, a thickness L2 of the adhesive 60 needs to be sufficiently large. However, when the second magnetic gap is large, leaking magnetic flux easily spreads outside, so that characteristics of other electronic components may be changed by the leakage magnetic flux in some cases. Further, it is difficult to control the second magnetic gap (i.e., control of the thickness L2) by the adhesive 60 with high accuracy.

On the other hand, in the coil component 10 according to the present embodiment, the gap G is formed in the winding core part 30 and functions as the first magnetic gap, so that many magnetic fluxes leaking from the first magnetic gap are shielded by the plate-like core 40. Thus, as compared to the coil component 10X according to the comparative example, the leakage magnetic flux can be suppressed from spreading. In addition, the gap G is formed at the intermediate position of the winding core part 30 in the x-direction, so that even when the mounting direction onto a printed board is rotated by 180°, the distribution of the leakage magnetic flux does not change, thus facilitating handling.

Figure 5A:
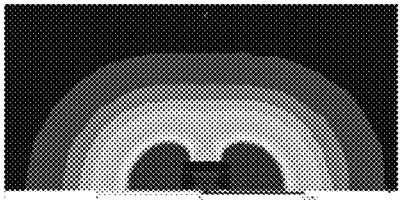
FIGS. 5A to 5D illustrate simulation results each representing the distribution of the leakage magnetic flux, where
Figure 5C:
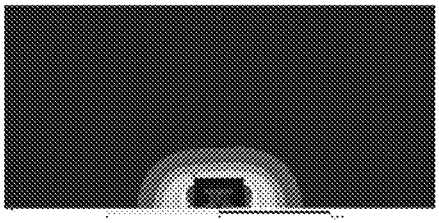
Figure 5B:
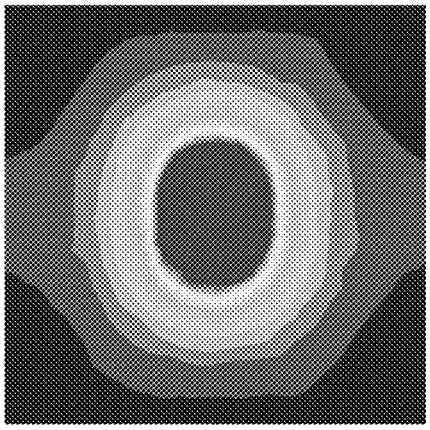
Figure 5D:
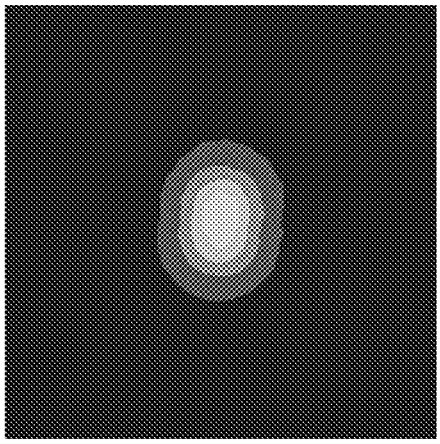

FIGS. 5A to 5D illustrate simulation results each representing the distribution of the leakage magnetic flux, where FIGS. 5A and 5B are views illustrating the spread of magnetic flux in the xz and xy directions, respectively, in the coil component 10X according to the comparative example, and FIGS. 5C and 5D are views illustrating the spread of magnetic flux in the xz and xy directions, respectively, in the coil component 10 according to the present embodiment.

As a simulation condition, L2 was set to 100 μm in the coil component 10X according to the comparative example, and L1 and L2 were set to 50 μm and 2 μm, respectively, in the coil component 10 according to the preset embodiment. Further, the numbers of wire turns in the coil components 10X and 10 were adjusted such that the inductance values of the coil components 10X and 10 coincide with each other.

As can be seen in FIGS. 5A to 5D, the leakage magnetic flux spreads significantly outside in the coil component 10X according to the comparative example, while the leakage magnetic flux is significantly suppressed from spreading in the coil component 10 according to the present embodiment. The reason that such an effect can be obtained is that, out of the magnetic flux leaking from the first magnetic gap, the magnetic flux directed in the z-direction is shielded by the plate-like core 40, and the magnetic flux directed in the x-direction is shielded by the first and second flange parts 31 and 32.

Hereinafter, coil components according to several modifications will be described.

Figure 6:
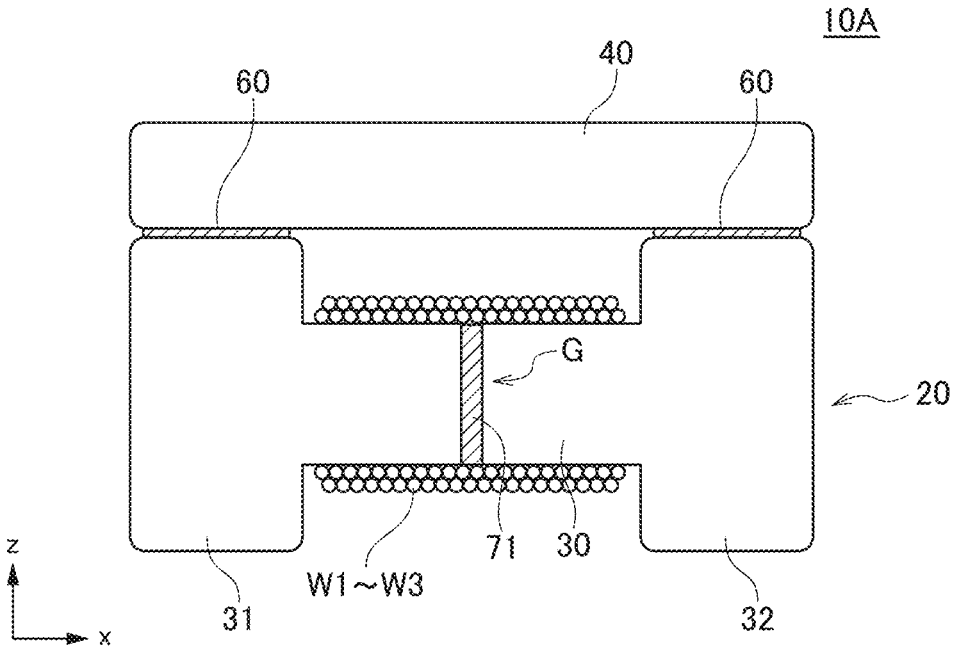
FIG. 6 is an xz cross-sectional view of a coil component 10A according to a first modification.

FIG. 6 is an xz cross-sectional view of a coil component 10A according to the first modification.

The coil component 10A illustrated in FIG. 6 differs from the above-described coil component 10 in that the gap G is filled with a non-magnetic material 71. Other configurations are the same as those of the coil component 10, so the same reference numerals are given to the same elements, and overlapping description will be omitted. In the coil component 10A according to the present modification, the two sections constituting the drum-shaped core 20 divided by the gap G are integrated by the non-magnetic material 71, facilitating winding work of the wires W1 to W3. In addition, the wires W1 to W3 can also be wound on the surface of the non-magnetic material 71, enhancing use efficiency of the winding core part 30. As the non-magnetic material 71, resin is preferably used.

Figure 7:
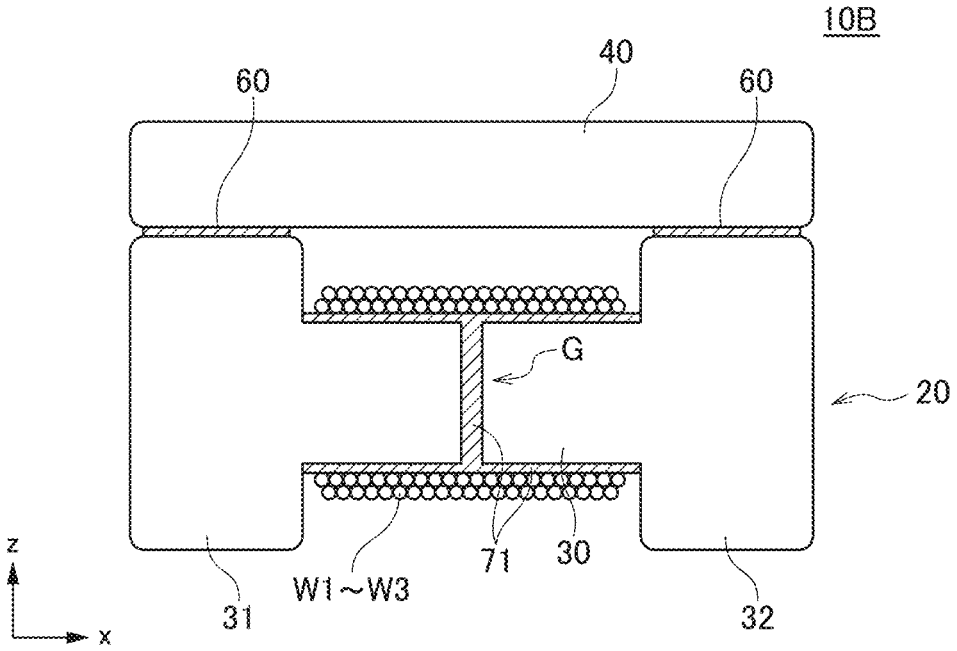
FIG. 7 is an xz cross-sectional view of a coil component 10B according to a second modification.

FIG. 7 is an xz cross-sectional view of a coil component 10B according to the second modification.

The coil component 10B illustrated in FIG. 7 differs from the above-described coil component 10A in that the non-magnetic material 71 is not only provided so as to fill the gap G but also provided on the surface of the winding core part 30. Other configurations are the same as those of the coil component 10A, so the same reference numerals are given to the same elements, and overlapping description will be omitted. In the present modification, the drum-shaped core 20 having the gap G is set in a die, and a non-magnetic resin material is molded to the winding core part 30, whereby the non-magnetic material 71 can be formed. According to this method, the width L1 of the gap G is accurately specified by the die and can thus be controlled with high accuracy.

Figure 8:
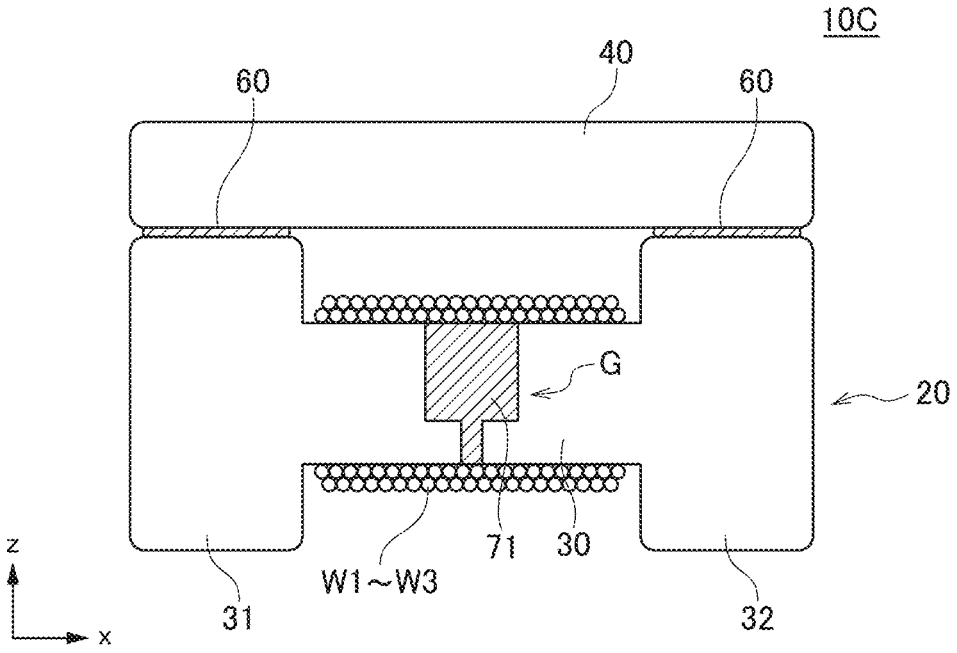
FIG. 8 is an xz cross-sectional view of a coil component 10C according to a third modification.

FIG. 8 is an xz cross-sectional view of a coil component 10C according to the third modification.

The coil component 10C illustrated in FIG. 8 differs from the above-described coil component 10A in that the gap G is not constant in width (L1) and has a large width part and a small width part. Other configurations are the same as those of the coil component 10A, so the same reference numerals are given to the same elements, and overlapping description will be omitted. In the present modification, the leakage amount of magnetic flux can be controlled according to the shape of the gap G. As exemplified in the coil component 10C according to the present modification, the width of the gap G may not necessarily be constant in the present invention.

Figure 9:
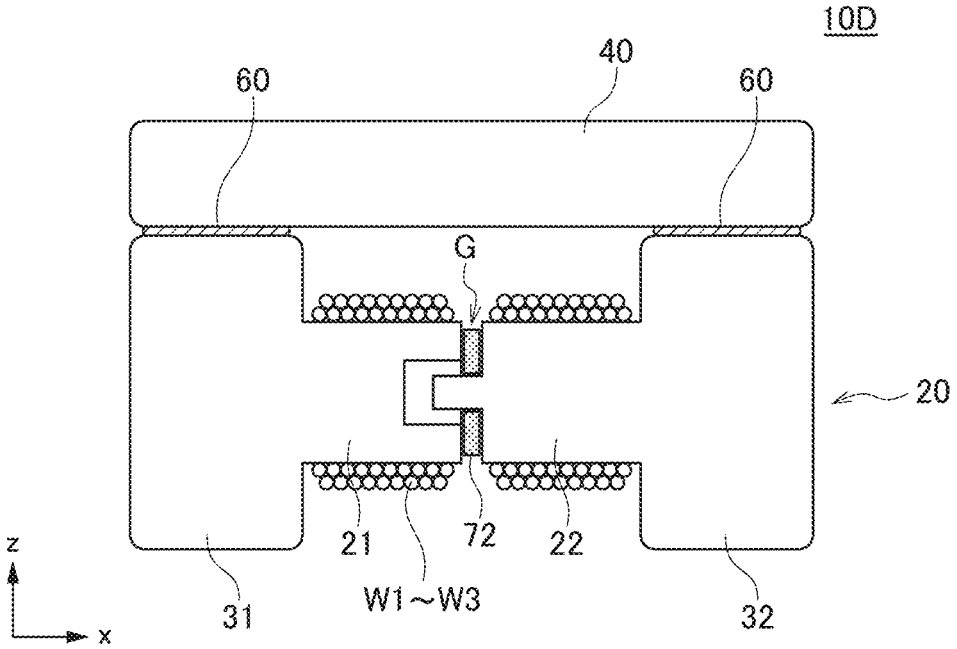
FIG. 9 is an xz cross-sectional view of a coil component 10D according to a fourth modification.

FIG. 9 is an xz cross-sectional view of a coil component 10D according to the fourth modification.

The coil component 10D illustrated in FIG. 9 differs from the above-described coil component 10 in that the two sections constituting the winding core part 30 divided by the gap G have shapes fitted to each other. Specifically, the winding core parts 30 belonging respectively to one and the other sides 21 and 22 of the drum-shaped core 20 are formed respectively into concave and convex shapes in cross section, and they are fitted to each other, whereby the drum-shaped core 20 is obtained. In this case, a non-magnetic washer 72 is interposed between the one and the other sides 21 and 22 of the drum-shaped core 20 so as not to allow them to directly contact each other in a fitted state. Other configurations are the same as those of the coil component 10, so the same reference numerals are given to the same elements, and overlapping description will be omitted. In the present modification, the one and the other sides 21 and 22 of the drum-shaped core 20 are easily positioned.

Figure 10:
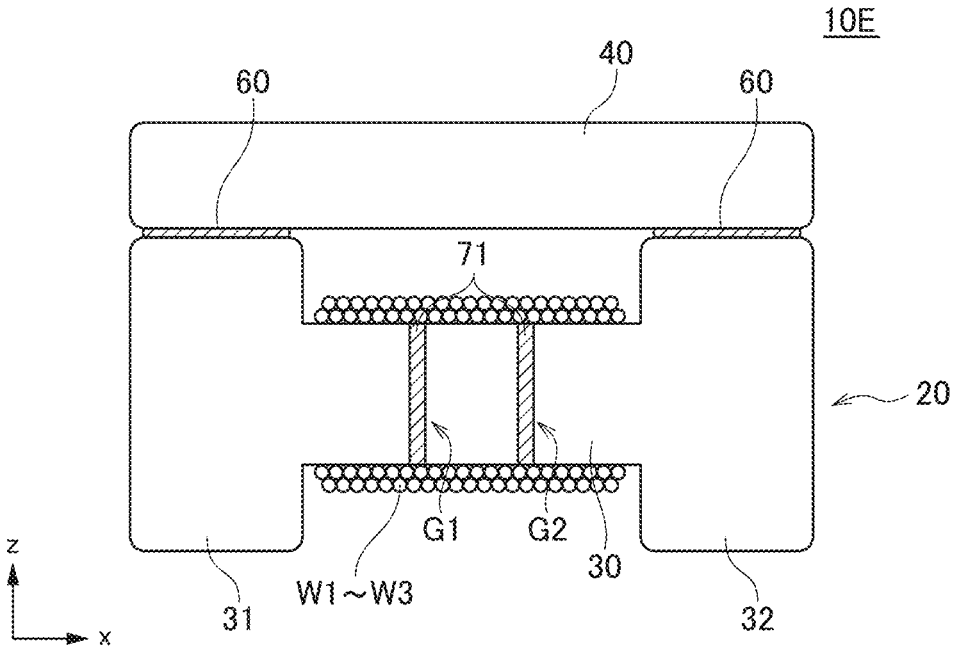
FIG. 10 is an xz cross-sectional view of a coil component 10E according to a fifth modification.

FIG. 10 is an xz cross-sectional view of a coil component 10E according to the fifth modification.

The coil component 10E illustrated in FIG. 10 differs from the above-described coil component 10 in that two gaps G1 and G2 are formed in the winding core part 30. Other configurations are the same as those of the coil component 10, so the same reference numerals are given to the same elements, and overlapping description will be omitted. As exemplified in the coil component 10E according to the present modification, the number of the gaps to be formed in the winding core part is not limited to one in the present invention, but may be two or more.

Figure 11:
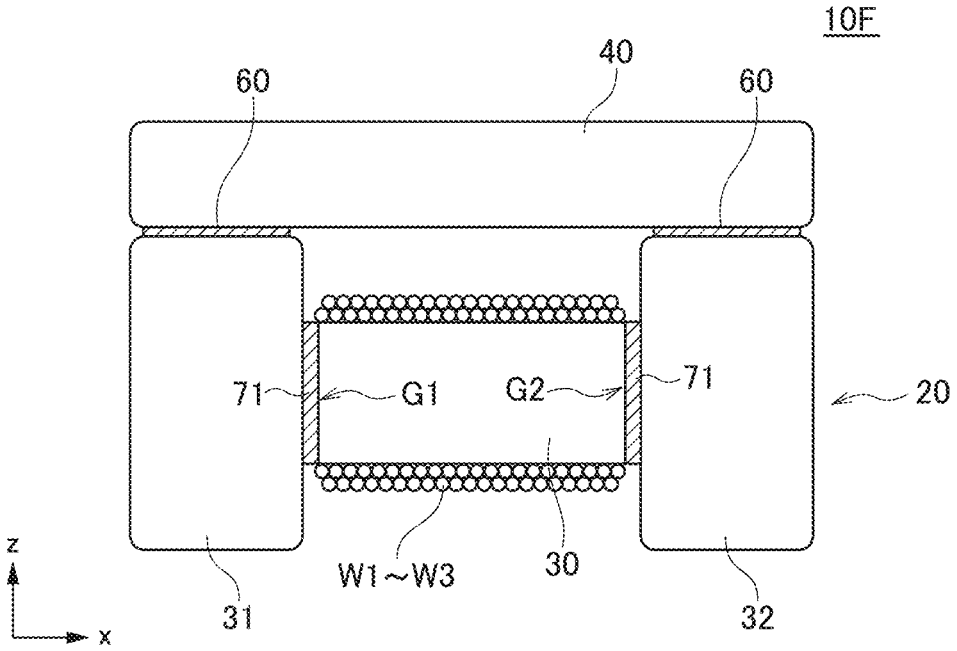
FIG. 11 is an xz cross-sectional view of a coil component 10F according to a sixth modification.

FIG. 11 is an xz cross-sectional view of a coil component 10F according to the sixth modification.

The coil component 10F illustrated in FIG. 11 differs from the above-described coil component 10E in that the two gaps G1 and G2 are formed respectively between the winding core part 30 and the first flange part 31 and between the winding core part 30 and the second flange part 32. Other configurations are the same as those of the coil component 10E, so the same reference numerals are given to the same elements, and overlapping description will be omitted. As exemplified in the coil component 10F according to the present modification, the gap may not necessarily be formed in the winding core part itself, but may be formed between the winding core part and the flange part. That is, it is sufficient to form the first magnetic gap in a magnetic path passing between the first and second flange parts 31 and 32 through the winding core part 30.

Figure 12:
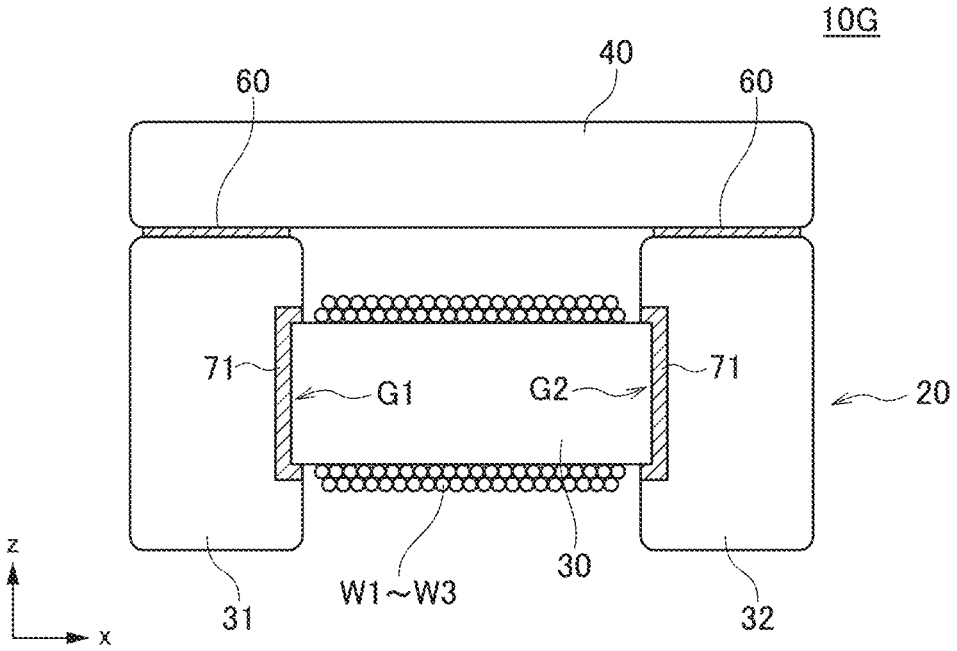
FIG. 12 is an xz cross-sectional view of a coil component 10G according to a seventh modification.

FIG. 12 is an xz cross-sectional view of a coil component 10G according to the seventh modification.

The coil component 10G illustrated in FIG. 12 differs from the above-described coil component 10F in that concave portions are formed respectively in the first and second flange parts 31 and 32, into which the winding core part 30 is inserted. Other configurations are the same as those of the coil component 10F, so the same reference numerals are given to the same elements, and overlapping description will be omitted. In the present modification, the winding core part 30 and the first and second flange parts 31 and 33 are easily positioned.

Figure 13:
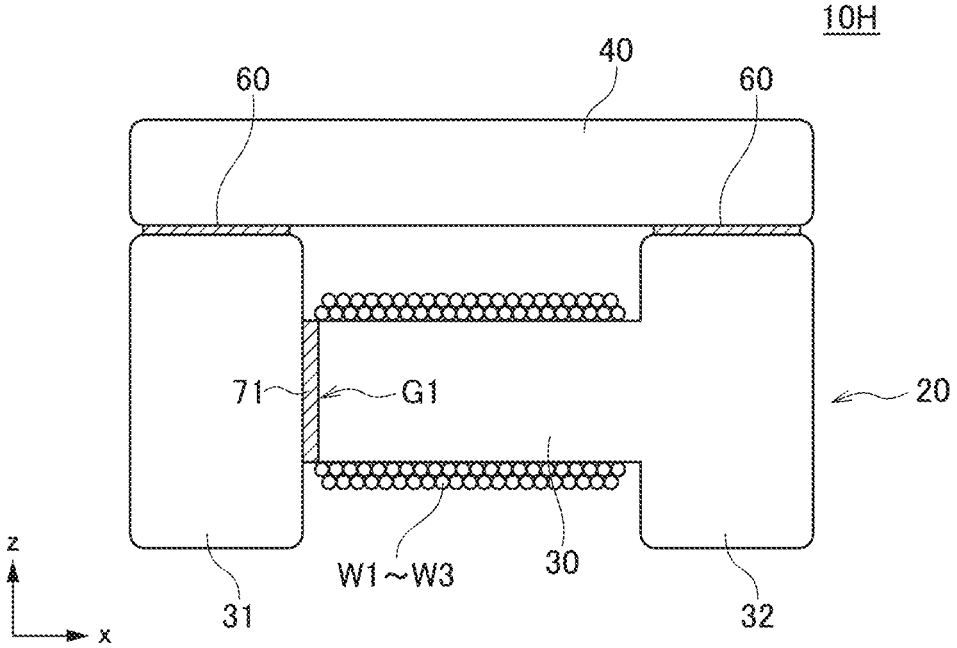
FIG. 13 is an xz cross-sectional view of a coil component 10H according to an eighth modification.

FIG. 13 is an xz cross-sectional view of a coil component 10H according to the eighth modification.

The coil component 10H illustrated in FIG. 13 differs from the above-described coil component 10G in that the gap G2 is omitted. Other configurations are the same as those of the coil component 10G, so the same reference numerals are given to the same elements, and overlapping description will be omitted. As exemplified in the coil component 10H according to the present modification, the position of the gap may be axially offset in the preset invention.

It is apparent that the present invention is not limited to the above embodiments, but may be modified and changed without departing from the scope and spirit of the invention.

REFERENCE SIGNS LIST

10, 10A-10H, 10X: coil component
20: drum-shaped core

21: one side of drum-shaped core
22: other side of drum-shaped core
30: winding core part
31: first flange part
32: second flange part
40: plate-like core
51-56: terminal electrode
60: adhesive
71: non-magnetic material
72: washer
G, G1, G2: gap
W1-W3: wire

What is claimed is:

1. A coil component comprising:

a drum-shaped core having a winding core part and first and second flange parts provided respectively at both ends of the winding core part in an axial direction of the winding core part;

a plate-like core fixed to the first and second flange parts;

a first terminal electrode provided on the first flange part;

a second terminal electrode provided on the second flange part; and a wire wound around the winding core part and having one end connected to the first terminal electrode and other end connected to the second terminal electrode, wherein a first magnetic gap is formed in a magnetic path passing between the first and second flange parts through the winding core part, wherein the first magnetic gap is a gap that divides the winding core part in the axial direction, wherein a second magnetic gap is formed between the first and second flange parts and the plate-like core, and wherein the first magnetic gap is made larger in size than the second magnetic gap.

2. The coil component as claimed in claim 1, wherein the first magnetic gap is formed at an intermediate position of the winding core part in the axial direction.

3. The coil component as claimed in claim 1, wherein the winding core part divided by the gap have shapes fitted to each other.

4. The coil component as claimed in claim 1, wherein the first magnetic gap is free from the wire.

5. The coil component as claimed in claim 1, wherein the first flange part and a part of the winding core part constitute a first magnetic block, and wherein the second flange part and a remaining part of the winding core part constitute a second magnetic block.

6. The coil component as claimed in claim 1, further comprising a non-magnetic material used to fill the first magnetic gap.

7. The coil component as claimed in claim 6, wherein the non-magnetic material is further formed on a surface of the winding core part.

8. A coil component comprising:

a first magnetic block having a first flange part and a first winding core part;

a second magnetic block having a second flange part and a second winding core part, wherein the first winding core part and the second winding core part face each other to form a first magnetic gap, a third magnetic block fixed to the first and second flange parts, wherein a second magnetic gap is formed between the third magnetic block and the first flange part, and wherein a third magnetic gap is formed between the third magnetic block and the second flange part; and a first wire wound around the first and second winding core parts, wherein the first magnetic gap is greater in width than each of the second and third magnetic gaps.

9. The coil component as claimed in claim 8, further comprising:

a first terminal electrode provided on the first flange part; and a second terminal electrode provided on the second flange part, wherein a first end of the first wire is connected to the first terminal electrode, and wherein a second end of the first wire is connected to the second terminal electrode.

10. The coil component as claimed in claim 9, further comprising:

second and third wires wound around the first and second winding core parts;

third and fifth terminal electrodes provided on the first flange part; and fourth and sixth terminal electrodes provided on the second flange part, wherein a third end of the second wire is connected to the third terminal electrode, wherein a fourth end of the second wire is connected to the fourth terminal electrode, wherein a fifth end of the second wire is connected to the fifth terminal electrode, and wherein a sixth end of the second wire is connected to the sixth terminal electrode.

11. The coil component as claimed in claim 8, wherein a width of the first magnetic gap is 20 μm to 100 μm.

* * * * *